US008967292B2

(12) United States Patent
Hammersmark et al.

(10) Patent No.: US 8,967,292 B2
(45) Date of Patent: Mar. 3, 2015

(54) METHOD AND DEVICE FOR ESTABLISHING A BOREHOLE IN THE SEABED

(75) Inventors: Jon Arne Hammersmark, Knarrevik (NO); Bernt Eikemo, Bergen (NO)

(73) Assignee: AGR Subsea AS, Straume (NO)

( * ) Notice: Subject to any disclaimer, the term of this patent is extended or adjusted under 35 U.S.C. 154(b) by 0 days.

(21) Appl. No.: 13/884,174

(22) PCT Filed: Nov. 8, 2011

(86) PCT No.: PCT/NO2011/000313

§ 371 (c)(1),
(2), (4) Date: Jun. 13, 2013

(87) PCT Pub. No.: WO2012/064199

PCT Pub. Date: May 18, 2012

(65) Prior Publication Data

US 2013/0256030 A1 Oct. 3, 2013

(30) Foreign Application Priority Data

Nov. 9, 2010 (NO) ..... 20101583

(51) Int. Cl.
*E21B 7/20* (2006.01)
*E21B 7/128* (2006.01)

(52) U.S. Cl.
CPC .. *E21B 7/20* (2013.01); *E21B 7/128* (2013.01)
USPC ..... 175/7; 166/358

(58) Field of Classification Search
CPC ..... E21B 7/20; E21B 7/124; E21B 7/128; E21B 21/01
USPC ..... 175/5–7; 166/358; 405/228, 232, 249, 405/253
See application file for complete search history.

(56) References Cited

U.S. PATENT DOCUMENTS

| | | | | | |
|---|---|---|---|---|---|
| 3,519,071 | A | * | 7/1970 | Word, Jr. | 166/351 |
| 3,608,652 | A | * | 9/1971 | Medders et al. | 175/7 |
| 3,621,910 | A | * | 11/1971 | Sanford et al. | 166/335 |
| 3,656,549 | A | * | 4/1972 | Holbert et al. | 166/356 |
| 3,672,447 | A | * | 6/1972 | Kofahl | 166/338 |
| 3,732,143 | A | * | 5/1973 | Joosse | 175/6 |
| 3,782,460 | A | * | 1/1974 | Skinner | 166/338 |
| 4,318,641 | A | * | 3/1982 | Hogervorst | 405/224 |
| 4,432,671 | A | * | 2/1984 | Westra et al. | 405/226 |
| 4,474,243 | A | * | 10/1984 | Gaines | 166/335 |
| 4,558,744 | A | * | 12/1985 | Gibb | 166/335 |
| 4,744,698 | A | * | 5/1988 | Dallimer et al. | 405/226 |
| 4,759,413 | A | * | 7/1988 | Bailey et al. | 175/6 |
| 4,770,255 | A | * | 9/1988 | Barthelemy et al. | 175/6 |
| 4,813,496 | A | * | 3/1989 | Rohweller et al. | 175/7 |

(Continued)

OTHER PUBLICATIONS

Dave Smith, AGR Subsea; Warren Winters, BP America; Brian Tarr and Robert Ziegler, Shell; and Iskandar Riza and Malik Faisal, PETRONAS, "Deepwater Riserless Mud Return System for Dual Gradient Tophole Drilling", SPE/IADC Managed Pressure Drilling and Underbalanced Operations Conference and Exhibition, Feb. 24-25, 2010, Kuala Lumpur, Malaysia.

*Primary Examiner* — Matthew Buck
(74) *Attorney, Agent, or Firm* — Foley & Lardner LLP

(57) ABSTRACT

A method and device for establishing a borehole (26) in the seabed (4), comprising setting of a conductor (1), wherein the method is characterized in that it comprises:—providing the conductor (1) with a suction module (6);—then lowering the conductor (1) down to the seabed (4); and—displacing the conductor (1) down into the seabed (4).

15 Claims, 3 Drawing Sheets

(56) References Cited

U.S. PATENT DOCUMENTS

| | | | | |
|---|---|---|---|---|
| 4,830,541 | A * | 5/1989 | Shatto | 405/226 |
| 4,904,119 | A * | 2/1990 | Legendre et al. | 405/228 |
| 5,246,075 | A | 9/1993 | Caulfield | |
| 5,704,732 | A * | 1/1998 | Horton, III | 405/228 |
| 6,659,182 | B1 * | 12/2003 | Saugier et al. | 166/358 |
| 2003/0029620 | A1 * | 2/2003 | Strand | 166/367 |
| 2007/0017680 | A1 * | 1/2007 | Wilde et al. | 166/360 |
| 2007/0017689 | A1 | 1/2007 | Polidori | |
| 2008/0226398 | A1 * | 9/2008 | Gibberd et al. | 405/223 |
| 2009/0114443 | A1 | 5/2009 | Talamo et al. | |
| 2010/0119309 | A1 * | 5/2010 | Gibberd | 405/228 |
| 2011/0158752 | A1 * | 6/2011 | Hitchin | 405/232 |
| 2011/0272194 | A1 * | 11/2011 | Finkenzeller | 175/7 |

* cited by examiner

III-III

METHOD AND DEVICE FOR ESTABLISHING A BOREHOLE IN THE SEABED

This invention concerns a method for establishing a borehole in the seabed. More particularly, it concerns a method for establishing a borehole in the seabed, comprising setting of a conductor. The invention also comprises a device for practising the method.

During establishment of a borehole in the seabed, typically in context of drilling a petroleum well, it is customary first to set a conductor (or tailpipe). Traditionally, a hollow is flushed out in the seabed, after which a conductor is set within the hollow. The hollow around the conductor is filled with concrete. Normally, this work is carried out before a drilling rig arrives at the drilling site.

Depending on the nature of the seabed, it may prove difficult to descend to the desired depth of the hollow. It may also occur that the hollow falls in partially before the conductor is in position. Moreover, experience goes to show that the conductor may remain standing deviating somewhat from a vertical position, which may render the further drilling operation somewhat difficult.

Prior art for setting of a conductor frequently involves a relatively large number of transports of equipment between the surface of the sea and the seabed as well as connection of pipes for supply and transport away of fluids.

The object of the invention is to remedy or to reduce at least one of the disadvantages of the prior art, or at least to provide a useful alternative to the prior art.

The object is achieved by virtue of features disclosed in the following description and in the subsequent claims.

A method for establishing a borehole in the seabed is provided, comprising setting of a conductor, wherein the method is characterized in that it comprises:

providing the conductor with a suction module;

then lowering the conductor down to the seabed; and displacing the conductor down into the seabed.

Typically, a suction module comprises a coupling structured in a manner allowing it to receive a pump. Further, a suction module is provided with necessary pipe couplings for allowing subsequent work operations, which are known per se, to be carried out. Normally, the suction module is also provided with necessary valves for being able to control fluid flows. The valves may also comprise closing valves, directional control valves and regulating valves. Advantageously, the suction module may be releasably connected to the conductor.

The conductor may communicate with a first pump pipe for connection to a pump module, given that the method may comprise lowering a pump module down to the suction module, wherein the pump of the pump module is connected to a return conduit extending to the surface of the sea.

The suction module renders possible to use of so-called riserless mud recovery (RMR). This is also suitable for being able to pump drill cuttings from the first phase of the drilling onto a waste disposal site on the seabed.

During the drilling rotation of the conductor, drilling fluid is not supplied, and the relatively modest amount of mass, which is liberated through drilling by means of the ring-shaped drilling tool, is mixed with water and flows upwards to a location above the seabed.

The method may comprise connecting the conductor to a drill pipe. The method ensures that the conductor, after disconnection from the drill string, remains standing substantially upright in the seabed.

Further, the method may comprise providing a lower portion of the conductor, when in an operational position, with a ring-shaped drilling tool. When the conductor is connected to a drill string, or to some other suitable rotatable pipe string, the conductor may, during rotation about a longitudinal axis thereof, displace the conductor down into the seabed and to a desired depth, even when experiencing difficult ground conditions.

The method may comprise providing the conductor with a base ("Permanent Guide Base" in English) before lowering the conductor down to the seabed and bringing, by virtue of rotation and displacement, the conductor down into the seabed until the base impacts the seabed.

By so doing, an additional work operation, which comprises lowering a base plate down and around the conductor on the seabed, is avoided.

The method may be carried out by means of a conductor for setting during establishment of a borehole in the seabed, wherein the conductor is characterized in that it is provided with a suction module.

The suction module may constitute a transition comprising necessary pipe connections from the conductor onto pumping equipment for the RMR system. Thus, the conductor may communicate with a pump pipe for connection to a pump module. The suction module may constitute a component between the conductor and the drill pipe.

The suction module may be provided with guide posts having guide ropes extending to the surface.

In one embodiment, the conductor is provided both with a base and a suction module before being releasably connected, typically by means of an adapter ("Running Tool" in English), to the drill pipe. In an alternative embodiment, the conductor may be connected to a rope before lowering the conductor down to the seabed.

When in an operational position, a lower portion of the conductor may be provided with a ring-shaped drilling tool. The ring-shaped drilling tool may comprise a shear made of a relatively hard material, or it may be provided with a relatively hard coating, generally comprising hard bodies, for example carbides.

The ring-shaped drilling tool may have an external diameter being insignificantly larger than the external diameter of the conductor, whereas the inner diameter of the drilling tool may be insignificantly smaller than the inner diameter of the conductor.

As mentioned, the conductor may be provided with a base.

The conductor may be provided with a fixed base structured to bear against the seabed when the conductor has been displaced to a desired depth in the seabed.

A ring-shaped borehole is formed in the seabed as the conductor, which may be subject to rotation, is progressively displaced downwards. The displacement is terminated when the base impacts the seabed sufficiently, after which the adapter between the drill pipe, possibly the cable, and the suction module is disconnected.

A pump module comprising a pump is then lowered down onto the suction module, wherein a pipe coupling of the pump module fits onto a pipe communicating with the conductor. A pump outlet of the pump module is connected to a pipeline extending, typically, to the surface of the sea, and generally to a drilling rig being used for the drilling. In a first phase of the drilling, the pipeline may be conducted to a waste disposal site on the seabed.

The drill pipe with a drill bit is then displaced into the suction module and downwards within the conductor, thereby drilling out mass located within the conductor, and then further down into the ground whilst drilling fluid flows downwards through the drill pipe onto the drill bit and returns, via the borehole and the conductor, to the pump, which pumps the drilling fluid and drill cuttings entrained therein to a desired location.

When the borehole has reached the desired depth, the drill pipe is pulled up and is disconnected from the conductor. A first casing is set, cemented and hung off in the conductor in a manner known per se. The cement displaces the drilling fluid located within the annulus between the first casing and the borehole.

Cement is pumped down until e.g. a change in the operating condition of the pump indicates that the cement has filled the annulus and is flowing into the pump. Water is then flushed through the pump.

Upon curing of the cement, the drilling of a smaller borehole for the next casing continues in a manner known per se. The drilling fluid may typically flow back via the borehole and the first casing and onwards to the pump via a second pump pipe having an inlet thereof located above the first casing.

Upon completing the drilling, the suction module is released from the conductor and is pulled to the surface together with the drill pipe, whereas the high-pressure connector of the casings remains on the seabed prepared for oncoming connection of blow-out preventers (BOP), and for continued drilling, for example down into a reservoir.

During the work, the pump module is provided with a light and a camera so as to allow monitoring of the work area on the seabed. The pump pumps the drilling fluid away from the borehole, thereby ensuring that the surroundings have clean water, which improves the monitoring possibility significantly.

The method and the device according to the invention allow for a significant saving of time during establishment of a borehole. This also ensures that the conductor is located in a desired position and direction within the seabed. The invention allows for a virtually pollution-free establishment of a borehole, which is becoming progressively more important when drilling is carried out in regions with a fragile nature.

Further, it is a significant advantage that the method may be practised when using a weighted drilling fluid, whereby dangers related to shallow gas pockets may be handled in a satisfactory manner.

Hereinafter, an example of a preferred method and embodiment is described and depicted in the accompanying drawings, where:

Figure 1:
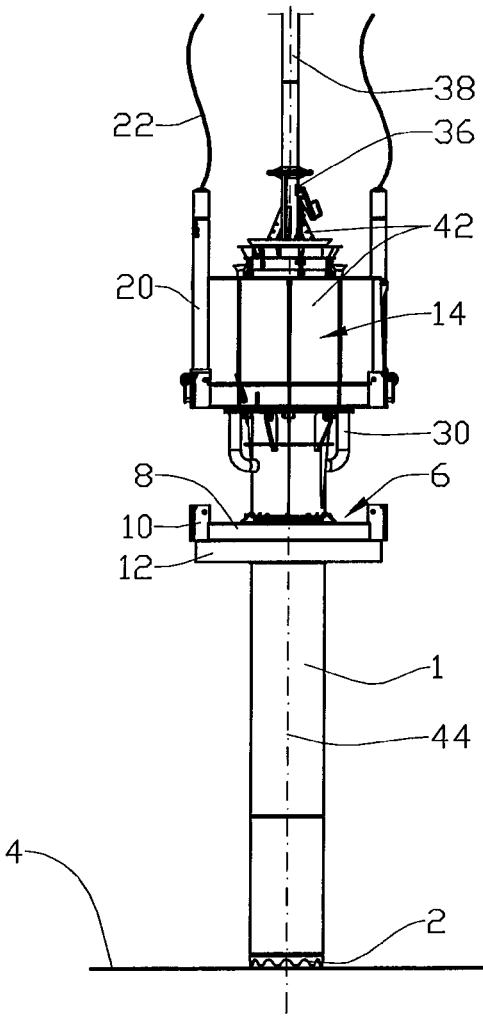
FIG. 1 shows a side view of a conductor according to the invention provided with a base and a suction module, the conductor of which is ready to be drilled down into the seabed.

In the drawings, reference numeral 1 denotes a conductor having, when in an operational position, a lower end portion provided with a ring-shaped drilling tool 2 structured in a manner allowing it to be drilled down into a seabed 4. The drilling tool 2 is formed as a corrugated ring of approximately the same internal and external diameters as those of the conductor 1.

The conductor 1 is provided with a fixed, surrounding base 6 located at a particular distance from the drilling tool 2. The base 6 comprises a structure 8 provided with a number of guide post attachments 10 and a skirt 12.

Figure 5:
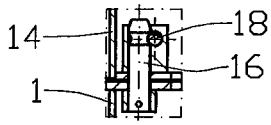
FIG. 5 shows, in larger scale, a cut-out section of FIG. 4.

At an upper portion thereof, when in an operational position, the conductor 1 is provided with a suction module 14. The suction module 14 is releasably connected to the conductor 1 by means of grooved pins 16, known per se, which are locked onto the suction module by means of pivotal locking spindles 18, see FIG. 5. The locking spindles 18 are structured in a manner allowing them to be rotated by a mini-submarine (not shown), i.e. a ROV (Remotely Operated Vehicle).

Figure 2:
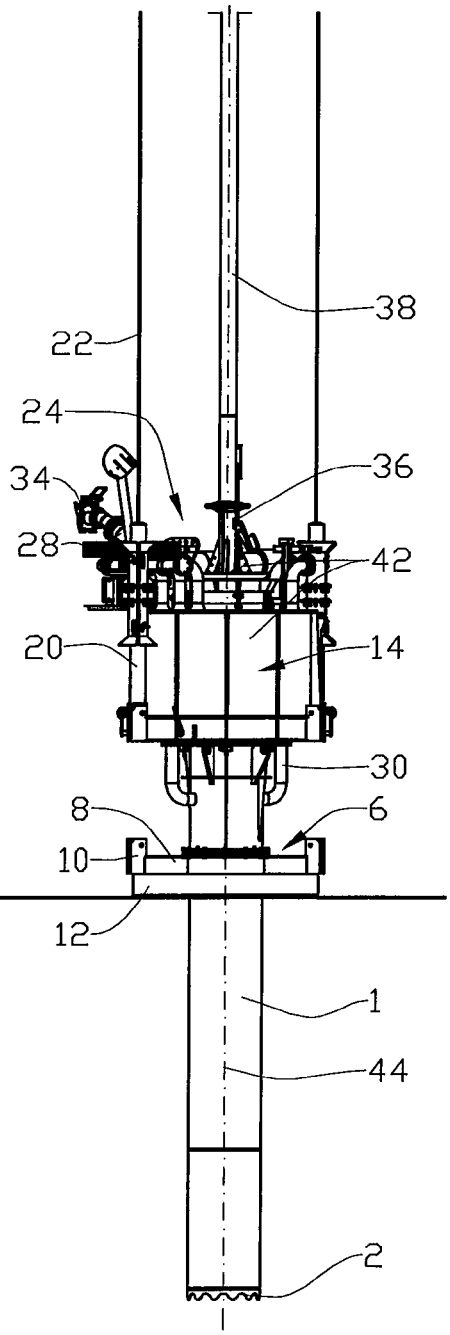
FIG. 2 shows the conductor drilled down into the seabed, and after having positioned a pump module onto the suction module.
Figure 3:
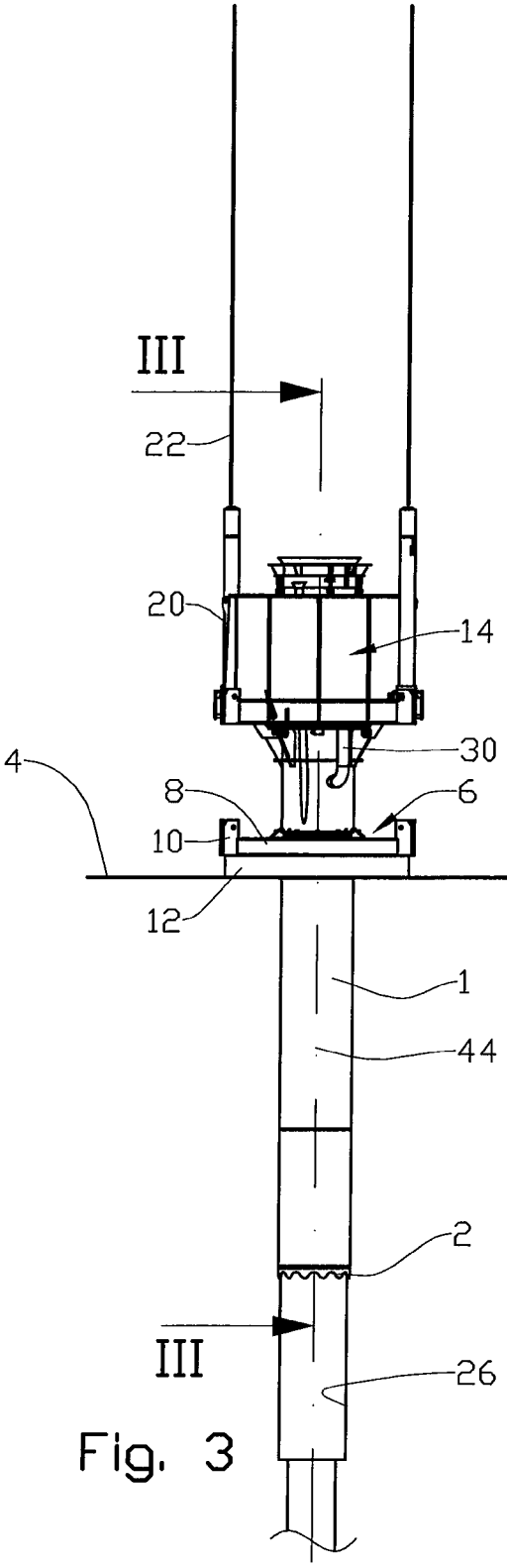
FIG. 3 shows the conductor after having set casings, and after having terminated the drilling and having retrieved the pump module from the suction module.

The suction module 14 is formed with guide posts 20 and guide ropes 22 extending to a drilling vessel (not shown). The guide ropes 22 and the guide posts 20 are structured in a manner allowing them to guide a pump module 24 to a position on the suction module, see FIG. 2. The suction module 14 is formed in a manner allowing it to catch drilling fluid being returned from a borehole 26.

Figure 4:
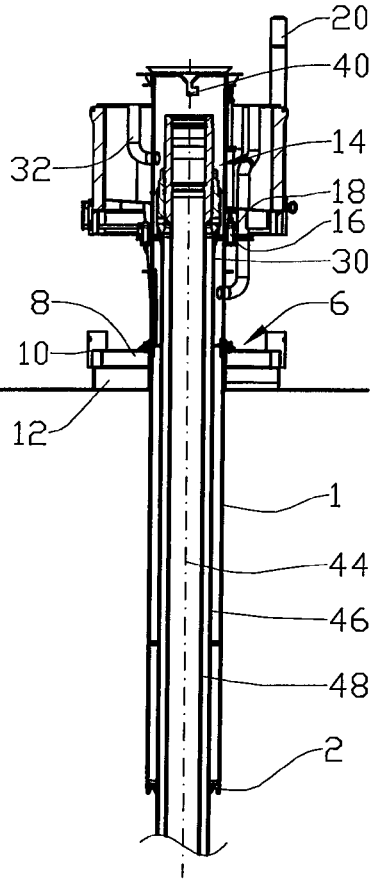
FIG. 4 shows a section in FIG. 3.

The pump module 24 comprises a pump 28 which, at a suction side thereof, is selectively connected to a first pump pipe 30 communicating with the conductor 1, a second pump pipe 32 having an inlet thereof at a higher location, see FIG. 4, and a water inlet (not shown). An outlet 34 of the pump 28 communicates with the drilling vessel (not shown).

The conductor 1, the base 6 and the suction module 14 have been assembled into a unit before being connected to a drill pipe 38 by means of an adapter 36.

In this preferred, exemplary embodiment, the adapter 36 is connected to the suction module 14 by means of a bayonet connector 40. The suction module 14 and the adapter 36 constitute components 42 for connection of the conductor 1 to the drill pipe 38.

The conductor 1 is lowered down to the seabed 4, see FIG. 1, after which the drill pipe 38, along with the conductor 1, is rotated about a longitudinal axis 44 thereof. Whilst under rotation, the conductor 1 is displaced downwards into the seabed at the same time as the drilling tool 2 liberates mass, which mixes with water and flows upwards, thereby allowing the conductor 1 to penetrate further down into the seabed 4.

When the base 6 has impacted the seabed 4, i.e. the skirt 12 in the embodiment shown has penetrated at least partially into the seabed 4, the rotation of the conductor 1 is terminated. Normally, the adapter 36 is disconnected from the suction module 14 before tightening the guide ropes 22 and lowering the pump module 24 and attaching it to the suction module 14.

The drill pipe 38, now having a drill bit (not shown) mounted thereon, is displaced down into the conductor 1 and further down into the seabed 4 whilst being rotated about the longitudinal axis 44. Drilling fluid, which may be weighted, is pumped down through the drill pipe 38 and flows back, i.e. between the borehole 26 and the conductor 1 and the drill pipe 38, to the pump 28 via the first pump pipe 30. The drilling fluid flows from the outlet 34 of the pump 28 and onwards to the drilling vessel (not shown).

The drilling is terminated at a desired depth. The drill pipe 38 is pulled up, and a first casing 46 is set and hung in a manner known per se. Then the drill pipe 38 is displaced, by means of a smaller drill bit (not shown), down to the bottom (not shown) of the borehole 26, after which cement is pumped down through the drill pipe 38. The cement displaces the drilling fluid around the first casing 46 and also fills the interior of the conductor 1 until cement flows through the first pump pipe 30 and onwards to the pump 28.

The cement changes the operating condition of the pump 28, which may be observed on the surface. The downward pumping of cement is stopped, and the water inlet (not shown) of the pump 28 is opened in order to clean the pump 28 and the outlet 34.

The drilling of a borehole (not shown) for a second casing 48 may then be initiated. Drilling fluid is now flowing back internally in the first casing 46 and onwards to the pump 28 via the second pump pipe 28, the inlet of which is located above the first casing 46.

The second casing 48 is cemented in a manner similar to that described for the first casing 46.

Figure 6:
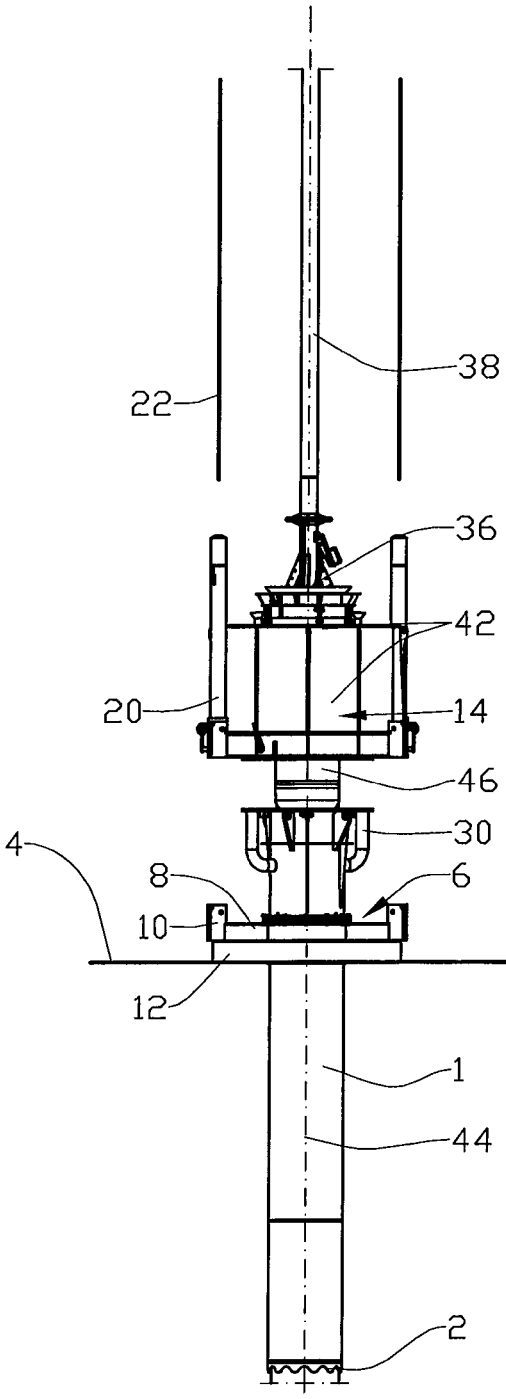
FIG. 6 shows the conductor as the suction module is being disconnected from the conductor.
Figure 7:
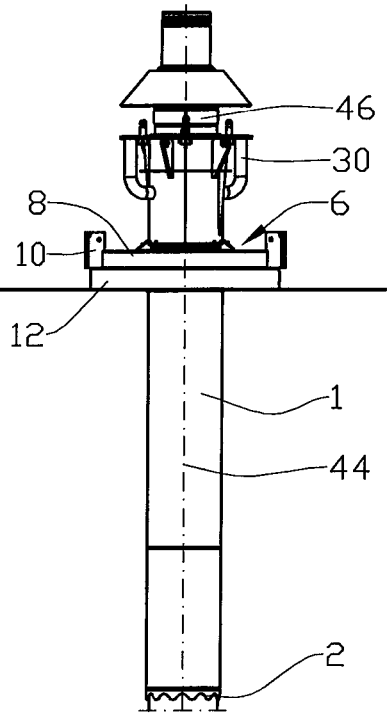
FIG. 7 shows the conductor provided with a protective cap and prepared for mounting of wellhead valves.

When the drilling operation is completed, the pump module 24 is retrieved first, after which the adapter 36 is connected to the suction module 14. Then the suction module 14 is released from the conductor 1, after which the suction module 14 follows the drill pipe 38 upwards to the drilling vessel (not shown), see FIG. 6.

High-pressure connectors belonging to the first and the second casings 46, 48 are standing, together with the conductor 1 and the base 6, on the seabed prepared for receiving wellhead valves (not shown).

The invention claimed is:

1. A method for establishing a borehole in a seabed, the method comprising:

setting a conductor;

providing a surrounding base that is fixedly connected to the conductor;

providing a suction module at a top end of the conductor;

providing a pump being in fluid communication with the conductor, the pump having an outlet that is connectable to a pipeline extending to a surface of the sea or to a waste disposal on the seabed;

connecting the conductor to a drill pipe and then lowering the conductor down to the seabed;

displacing the conductor down into the seabed until the fixed surrounding base bears against the seabed; and creating the borehole such that drilling fluid and drilling out mass flow back via the borehole and the conductor to the pump.

2. The method according to claim 1, wherein the method further comprises:

providing the drill pipe with a drill bit, and displacing the drill pipe provided with the drill bit into the conductor and further down into the seabed such that drilling fluid, drilling out mass and drill cuttings flow back via the borehole and the conductor to the pump.

3. The method according to claim 1, wherein the method further comprises:

providing a lower portion of the conductor, when in an operational position, with a ring-shaped drilling tool, and by virtue of displacement, lowering the conductor down into the seabed.

4. The method according to claim 1, wherein the method further comprises:

positioning a first casing in the borehole; and pumping cement down the drill pipe such that the cement displaces the drilling fluid around the first casing, fills an interior of the conductor, and flows onwards to the pump.

5. The method according to claim 4, wherein the method further comprises:

drilling a borehole for a second casing such that drilling fluid and drill cuttings flow back internally in the first casing and onwards to the pump via an inlet in the suction module above the first casing;

positioning, in the borehole, a second casing provided with a high-pressure connector at an upper end;

hanging off the second casing in the first casing; and pumping cement down the drill pipe such that the cement displaces the drilling fluid around the second casing until cement flows to the pump.

6. The method for establishing a borehole in a seabed of claim 1, wherein the borehole is configured to permit extraction of petroleum.

7. The method for establishing a borehole in a seabed of claim 3, wherein the conductor is lowered down into the seabed by virtue of displacement and rotation.

8. A conductor apparatus for establishment of a borehole in a seabed, the apparatus comprising:

a conductor, a surrounding base that is fixedly connected to the conductor, an external first pump pipe provided at an upper portion of the conductor, the external first pump pipe communicating with the conductor, and a releasable member configured to releasably connect a suction module, the releasable member being provided at a top end of the conductor, wherein the external first pump pipe is fixed with the conductor.

9. The conductor apparatus according to claim 8, wherein a lower portion of the conductor, when in an operational position, is provided with a ring-shaped drilling tool.

10. The conductor apparatus according to claim 9, wherein the ring-shaped drilling tool is formed as a corrugated ring of approximately the same internal and external diameters as those of the conductor.

11. The conductor apparatus of claim 8, wherein the borehole is configured to permit extraction of petroleum.

12. A suction module structured for releasable connection to a conductor, the suction module comprising:

a locking member configured to releasably connect to the conductor at a top end of the conductor; and a guide member configured to guide a pump module to a position on the suction module, the pump module comprising a pump which, at a suction side thereof, is selectively connected to a fixed, external first pump pipe connected to the conductor, wherein the pump module comprises a pump outlet configured to direct drill cuttings to at least one of a waste disposal site and the surface of the sea.

13. A suction module structured for releasable connection to a conductor, the suction module comprising:

a locking member configured to releasably connect to the conductor at a top end of the conductor; and a guide member configured to guide a pump module to a position on the suction module, the pump module comprising a pump which, at a suction side thereof, is selectively connected to the conductor, wherein the pump module comprises a pump outlet configured to direct drill cuttings to at least one of a waste disposal site and the surface of the sea, and wherein the suction module is provided with attachments which, via at least one intermediate component, fit onto a drill pipe.

14. The suction module according to claim 13, wherein the pump outlet of the pump module is connected to a pipeline extending to the surface of the sea.

15. The suction module according to claim 14, wherein the pump outlet of the pump module is connected to a pipeline extending to the waste disposal site.

* * * * *